US005787957A

United States Patent [19]

Nagarwalla et al.

[11] Patent Number: 5,787,957

[45] Date of Patent: Aug. 4, 1998

[54] APPARATUS AND METHODS FOR INJECTING AND GASSING OF SAND

[75] Inventors: Pheroze J. Nagarwalla, St. Charles; Raymond F. Witte, Naperville, both of Ill.; Scott S. Hendrie, Coldwater, Mich.

[73] Assignee: Georg Fischer Disa, Inc., Oswego, Ill.

[21] Appl. No.: 671,847

[22] Filed: Jun. 28, 1996

[51] Int. Cl.[6] ..... B22C 9/10; B22C 9/12; B22C 15/24

[52] U.S. Cl. ..... 164/16; 164/21; 164/186; 164/201

[58] Field of Search ..... 164/16, 18, 20, 164/21, 22, 28, 186, 200, 201, 202

[56] References Cited

U.S. PATENT DOCUMENTS

| | | | |
|---|---|---|---|
| 2,899,724 | 8/1959 | Peterson . | |
| 2,911,691 | 11/1959 | Peterson . | |
| 4,390,056 | 6/1983 | Grove et al. | 164/7.1 |
| 4,809,763 | 3/1989 | Schilling | 164/28 |
| 4,836,269 | 6/1989 | Bellis et al. | 164/200 |
| 5,038,845 | 8/1991 | Kluge | 164/22 |
| 5,355,929 | 10/1994 | Sorensen | 164/20 |

FOREIGN PATENT DOCUMENTS

| | | | |
|---|---|---|---|
| 0 640 418 | 3/1995 | European Pat. Off. . | |
| 234381 | 5/1910 | Germany . | |
| 396813 | 6/1924 | Germany . | |
| 527222 | 5/1931 | Germany . | |
| 646304 | 6/1937 | Germany | 164/201 |
| 285837 | 11/1970 | Germany . | |
| 620382 | 11/1980 | Switzerland . | |
| 1197768 | 12/1985 | U.S.S.R. . | |

*Primary Examiner*—J. Reed Batten, Jr.
*Attorney, Agent, or Firm*—Marshall, O'Toole, Gerstein, Murray & Borun

[57] ABSTRACT

The injection tube for injecting and gassing of foundry sand in cavities in a core box has a first passage for passing sand and a second passage for passing hardening fluid. Sand may be injected simultaneously to the introduction of hardening fluid into the cavities. Alternatively, sand may be injected prior to introduction of hardening fluid into the cavities.

27 Claims, 12 Drawing Sheets

APPARATUS AND METHODS FOR INJECTING AND GASSING OF SAND

TECHNICAL FIELD

The present invention relates to foundry equipment and more specifically to apparatus and methods for forming sand cores and sand molds.

BACKGROUND ART

Sand molds are commonly used as cores for casting processes in which a flowable material is cast around the sand core to form a part. When sand is employed to form the sand cores, it must be conditioned and controlled to give satisfactory and uniform results. Typically, the sand is conditioned with additives (typically a resin) to meet four requirements: refractoriness, cohesiveness, permeability, and collapsibility. The various methods for conditioning sand generally fall within two broad categories: the "hot box" method and the "cold box" method. Each method requires the additives to be combined with the sand and then the curing of the mixture.

There are several disadvantages to the hot box method. Costly heating equipment is needed to heat the core box and keep it hot to polymerize the resin. If the core box cools, the lag time necessary to reheat the core box slows production. Also, the temperature of the core box must be closely regulated to insure proper polymerization of the resin. Further, the core box is costly because it must be able to withstand the continuous heat.

The cold box method does not require the addition of heat. Typically, the cold box method requires a resin to be mixed with the sand and then polymerized by the action of a curing agent, such as a catalyst.

Typically, in the cold box method, a mixture of sand and resin is blown into the core box at one location during the forming operation. The core box is then transferred by a transfer mechanism to a second location at which the catalyst is added. Alternatively, the catalyst injection apparatus may be transferred to the core box. A catalyst is then introduced into the mold causing the resin to harden.

One of the disadvantages encountered in the conventional cold box method is the necessity of transferring the core box or catalyst injection apparatus. Depending upon the size and complexity of the machine and core box, the cost of the transfer mechanism could account for several thousand dollars. Further, the machine cycle time is increased by 3 to 10 seconds for the transfer motion and the core requires between 1 and 10 seconds for the addition of the catalyst, excluding purge time.

Simultaneous injection of sand and introduction of hardening fluid avoids the need to transfer the core box or catalyst injection apparatus. It also avoids the need to completely remove the sand injection tubes from the core box to allow for placement of a gassing plate on the core box, following sand injection, for performing the core hardening step.

However, conventional simultaneous injection generally results in a soft portion in the hardened cores at an area adjacent the injection tube. Such a soft portion is undesirable in some cores, particularly those cores in which the soft portion is not in the core print area. For those cores, the soft portion would contact molten metal during casting and result in poor quality castings. Thus, typical simultaneous injection apparatus can only be used to produce a limited number of core geometries, namely those cores in which the soft portion is in the core print area.

Typical apparatus for simultaneously injecting sand and introducing hardening fluid have been limited to a design wherein each injection tube releases sand and hardening fluid parallel to the longitudinal axis of the injection tube. Some cavities, however, are more effectively filled with sand injected in a direction other than parallel to the longitudinal axis of the injection tube. Conventional injection tubes for the simultaneous injection of sand and introduction of hardening fluid are not fully effective at producing cores in these cavities.

SUMMARY OF THE INVENTION

The above disadvantages of the prior art devices are overcome by the present invention.

More specifically, apparatus for forming cores in a core box includes an injection tube having first and second ends and a side wall disposed between the first and second ends. A sand injection passage is disposed in the injection tube and a hardening fluid passage also is disposed in the injection tube. At least one of the sand injection passage and the hardening fluid passage includes an outlet in the side wall.

The sand injection passage and the hardening fluid passage may include first and second outlets, respectively, in the side wall. Additionally, the first and second outlets may be disposed at different distances from one of the first and second ends. Alternatively, the first and second outlets may be disposed at substantially equal distances from one of the first and second ends.

In another embodiment, apparatus for injecting foundry sand into a core box having a cope, a drag, and a cavity therebetween includes an injection tube having a bottom, a wall including an outer surface, a first passage for passing foundry sand into the cavity, and a second passage for passing hardening fluid into the cavity. The first passage has a first inlet, a first outlet located adjacent the outer surface of the injection tube wall, and a first lateral portion extending to the first outlet. The second passage has a second inlet, a second outlet located adjacent the outer surface of the injection tube wall, and a second lateral portion extending to the second outlet.

The first and second outlets may be located level with a parting line defined by the cope and the drag during sand injection. Alternatively, the first outlet may be located level with the parting line during sand injection while the second outlet is not located level with the parting line during sand injection. Also alternatively, the second outlet may be located level with the parting line during introduction of hardening fluid while the first outlet is not located level with the parting line during introduction of hardening fluid.

In a further embodiment, the first lateral portion is perpendicular to a longitudinal axis of the injection tube. The second lateral portion may also be perpendicular to the longitudinal axis of the injection tube.

The apparatus may further include means for injecting sand through the first inlet into the cavity and means for introducing hardening fluid through the second inlet into the cavity.

According to another aspect of the present invention, apparatus for injecting foundry sand into a core box includes an injection tube having a bottom, a first passage for passing foundry sand into a cavity in the core box, and a second passage for passing hardening fluid into the cavity. The first passage has a first inlet and a first outlet. The second passage has a second inlet and a second outlet. The first and second outlets are located different distances from the bottom of the injection tube.

A further aspect of the invention is a method for producing hardened sand cores in a cavity of a core box. The method includes the steps of providing a tube having a first passage including a first outlet and a second passage having a second outlet; injecting sand through the first passage into the cavity to produce cores; adjusting the position of the tube relative to the core box to place the second outlet in fluid communication with the cavity; and introducing hardening fluid through the second passage into the cavity to harden the cores.

A still further aspect of the present invention is a method for producing hardened sand cores in a cavity of a core box including the steps of providing a tube having a first passage including a first outlet located adjacent an outer radial surface of the tube and a second passage having a second outlet located adjacent the outer radial surface of the tube; injecting sand through the first passage into the cavity to produce cores; and introducing hardening fluid through the second passage into the cavity to harden the cores.

The foregoing and other advantages of the invention will appear more fully hereinafter from a consideration of the detailed description which follows taken together with the accompanying drawings. It is to be expressly understood, however, that the drawings are for illustration purposes only and are not to be construed as defining the limits of the invention, reference being had to the appended claims for that purpose.

DESCRIPTION OF THE PREFERRED EMBODIMENTS

Figure 1:
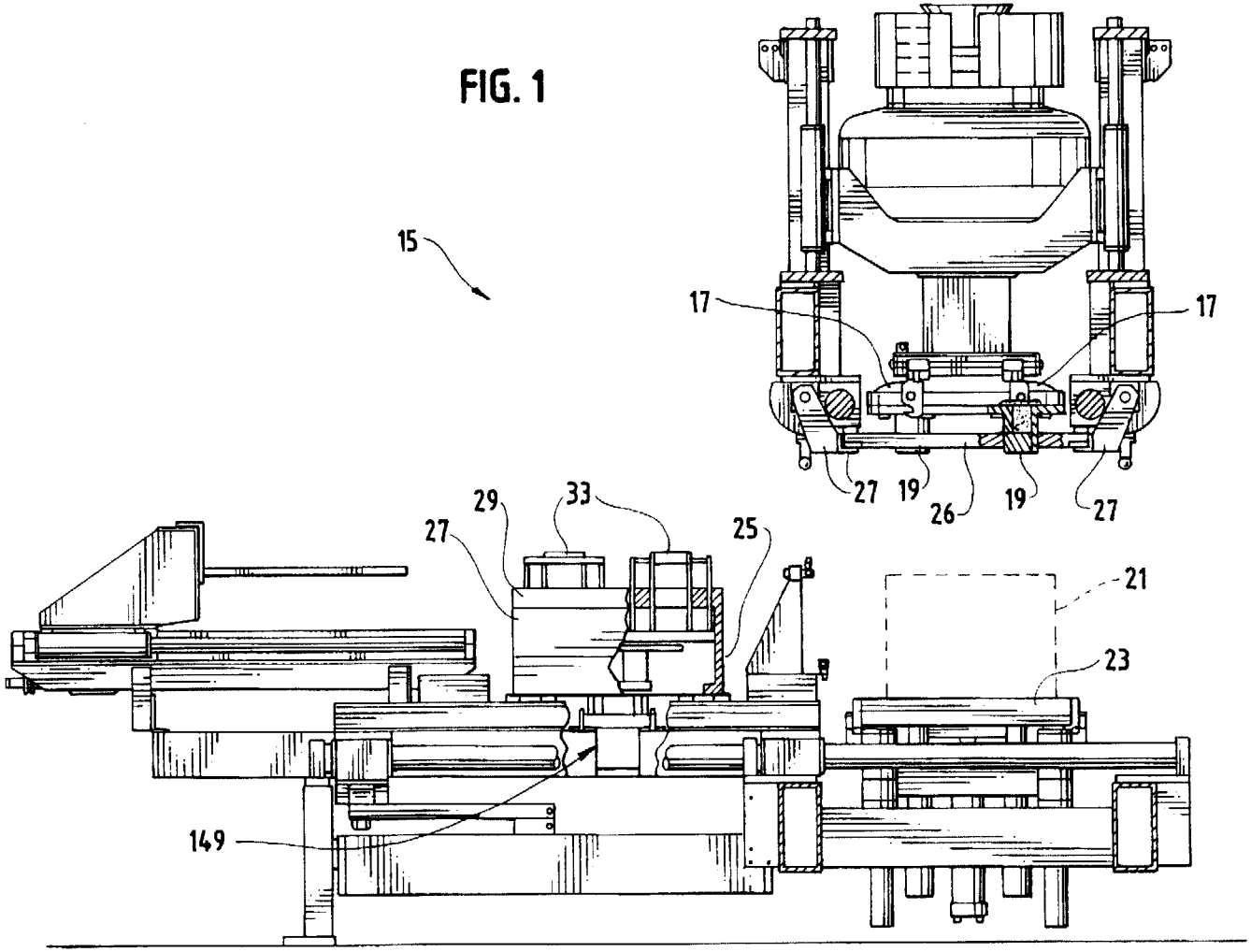
FIG. 1 comprises a side elevational view, with portions broken away, of a core making apparatus having injection tubes in accordance with the present invention.

In the drawings and following description, like reference numerals refer to like elements.

Figure 2:
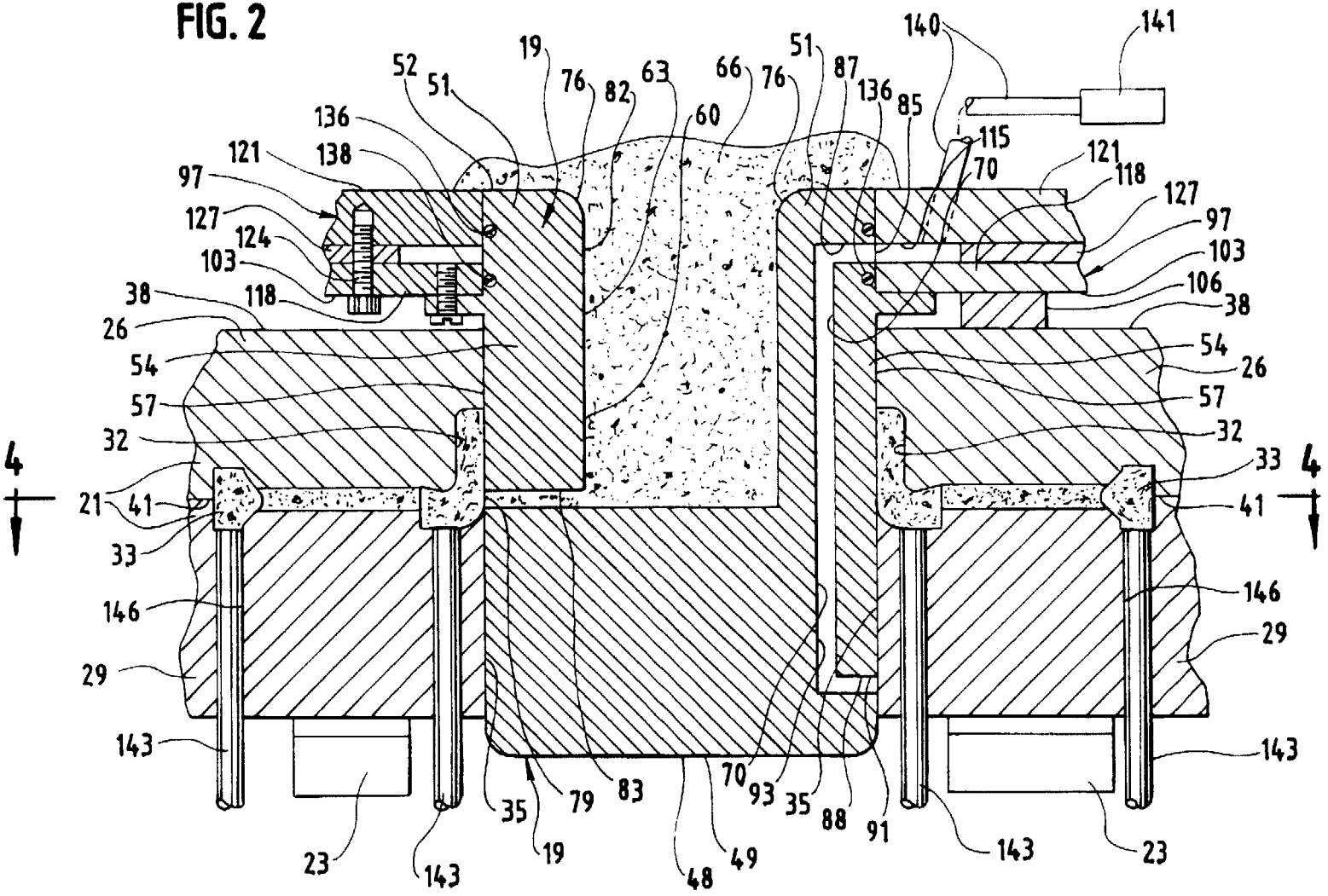
FIG. 2 comprises a full sectional view of an injection tube in accordance with the present invention shown in a core box during sand injection.
Figure 3:
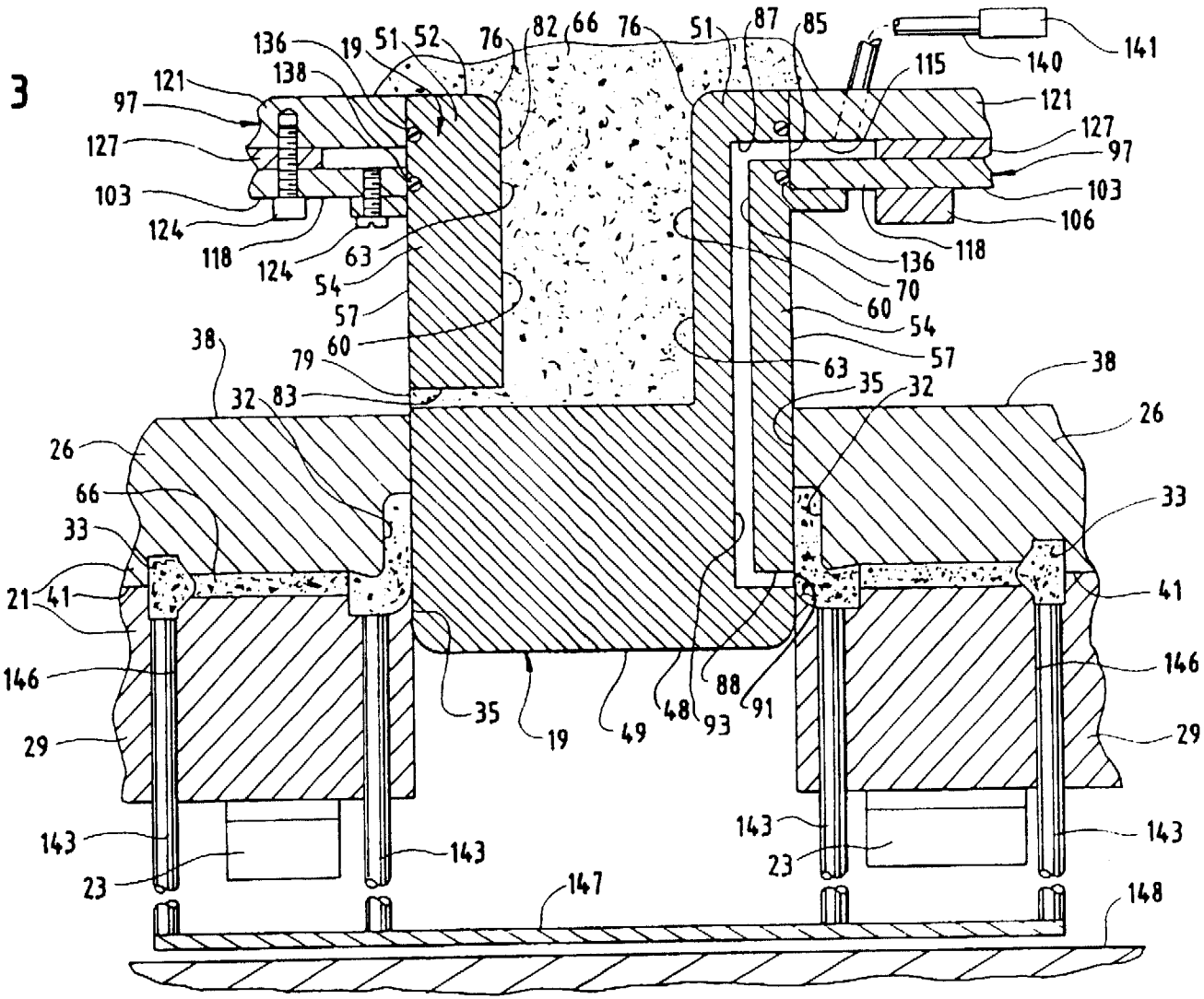
FIG. 3 comprises a view similar to FIG. 2 of the injection tube shown in a position for the introduction of core hardening fluid.

Referring initially to FIGS. 1–3, a molding apparatus indicated generally at 15 includes a blowhead or extruding head 17 having one or more injection tubes 19, a core box 21, and a ram 23 for raising and lowering the core box 21. The core box 21 has a stool 25, a cope 26 (shown secured by cope clamps 27 in FIG. 1), and a drag 29 (separated from the cope 26 in FIG. 1). When assembled, the cope 26 and the drag 29 define one or more cavities 32 (FIGS. 2 and 3) therebetween for forming one or more cores 33 and a bore 35 extending from a top surface 38 of the cope 26 to below a parting line 41 located between the cope 26 and the drag 29.

The cope 26 and the drag 29 may be pressed or clamped together during molding by any appropriate apparatus. For example, the cope 26 may be maintained at a fixed height by the cope clamps 27 (FIG. 1), and the drag 29 may be lifted by the ram 23 into a position against the cope 26.

The injection tube 19 is extendable into the bore 35 defined by the cope 26 and the drag 29. The injection tube 19 has a bottom surface 48 at a first end 49, a top portion 51 at a second end 52, and an outer side wall 54, preferably cylindrical in shape and having an outer surface 57 and an inner surface 60. The injection tube 19 also has a first passage 63 for passing sand 66 into the cavity 32, and a second passage 70 for passing hardening fluid into the cavity 32.

The first passage 63 has a first inlet 76 at the top portion 51 of the tube 19 and a first outlet 79 located between the bottom surface 48 of the tube 19 and the first inlet 76. A main portion 82 of the first passage 63 is defined by the inner surface 60 of the wall 54 of the injection tube 19. A first lateral portion 83 of the first passage 63 extends through the wall 54 to the first outlet 79.

The second passage 70 includes a second inlet 85 located at the top portion 51, an inlet portion 87, and a second lateral portion 88 in fluid communication with the second inlet 85 and a second outlet 91. A main portion 93 of the second passage 70 extends between and is in fluid communication with the inlet portion 87 and the second lateral portion 88. Preferably, the first passage 63 does not intersect the second passage 70 so that fluid communication between the first and second passages 63, 70 is avoided.

Attached to the top portion 51 of the tube 19 is a blowplate or extruding plate 97 having a bottom surface 103 and a support block 106 fixed thereto by any suitable means, such as by welding. The support block 106 is in contact with the cope 26 when the injection tube 19 is fully inserted into the bore 35 and thus determines the vertical position of the tube 19 relative to the components of the core box 21 during such time.

The first inlet 76 is in fluid communication with the blowhead 17 which delivers the core sand 66 through the first inlet 76. The blowhead 17 is clamped to the blowplate 97 by conventional clamping apparatus prior to and during sand injection.

Referring to FIGS. 2 and 3, the second inlet 85 is in fluid communication with a conduit 115 formed between a bottom portion 118 of the blowplate 97 and a top portion 121 of the blowplate 97. A spacer block 127 is disposed between the top and bottom portions 121, 118 of the blowplate 97 and the elements 118, 121, and 127 may be secured together by any suitable means, such as fasteners.

Seals in the form of O-rings 136 are disposed in seal recesses 138 at the interface of the tube 19 and the blowplate 97 around the second inlet 85. The seals 136 prevent hardening fluid from flowing outside of the second inlet 85 into the sand 66 in and above the tube 19, thereby preventing undesired hardening of the sand 66 at such points.

Attached to the top portion 121 of the blowplate 97 is a hose 140 connected to a gassing head 141 or any other source of hardening fluid, which may be remote. If the hardening fluid is a curing gas, for example, the hardening fluid may be supplied to the second inlet 85 by pressurized tanks connected to the hose 140.

The first and second outlets 79, 91 in the embodiment shown in FIGS. 2–5 are located at different distances from the bottom surface 48 of the injection tube 19. In the illustrated embodiment, the first outlet 79 is preferably, although not necessarily, located farther from the bottom surface 48 than the second outlet 91.

Both the first and second lateral portions 83, 88 are preferably oriented perpendicular to the longitudinal axis of the tube 19, as shown in FIGS. 2 and 3. If desired, the first and second lateral portions 83, 88 may instead be oriented at transverse angles other than a right angle with respect to the longitudinal axis of the tube 19. The geometry of the core 33 is one factor that determines the optimum orientation of the lateral portions 83, 88.

Although only a single tube 19 is illustrated in FIGS. 2–5, the core box 21 may accommodate more than one tube 19, as shown in FIG. 1. Also, although only a single cavity 32 and a single core 33 are illustrated in FIGS. 2–5, the core box 21 can have a plurality of cavities 32 and can therefore form a plurality of cores 33 per cycle.

In operation, the blowhead 17 and the tube 19 clamped thereto are lowered until the support block 106 is in contact with the top 38 of the cope 26. Alternatively, the core box 21 may be raised (or the blowhead 17 and the tube 19 may be lowered as the core box 21 is raised) until the top 38 of the cope 26 contacts the support block 106. At this point, the first outlet 79 is placed in fluid communication with the cavity 32 and the sand 66 may then be injected by the blowhead 17 through the first passage 63 and the first outlet 79 into the cavity 32.

Air flow accompanying the sand 66 as the sand 66 is injected exits the cavity 32 through vents (not shown) in the core box 21 and flows into a scrubber (not shown). After sand injection is completed, pressurized air is exhausted through the blowhead 17.

Figure 5:
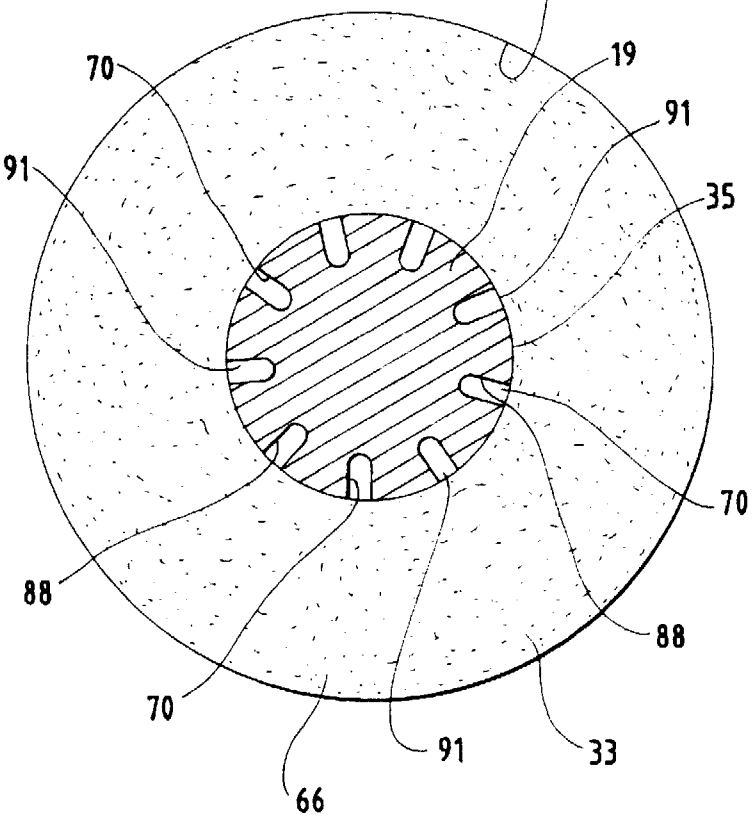
FIG. 5 comprises a sectional view similar to FIG. 4 of the injection tube shown in a position for the introduction of core hardening fluid.

As seen in FIG. 2, during sand injection, the second outlet 91 is not in fluid communication with the cavity 32. Following the completion of sand injection, however, the tube 19 is lifted by the blowhead 17 (or the tube 19 and the core box 21 are otherwise relatively moved) to a height at which the second outlet 91 is placed in fluid communication with the cavity 32. As seen in FIGS. 3 and 5, the first outlet 79 is taken out of fluid communication with the cavity 32 when the tube 19 is in this position. Hardening fluid is then delivered through the conduit 115, the second inlet 85, the second passage 70 and the second outlet 91 into the cavity 32.

It is to be understood that the term "hardening fluid" as used herein is intended to mean any gas, liquid, particulate, or other material which is flowable. Gas catalysts are preferred hardening fluids because gas catalysts generally have lower reaction times and therefore generally cure the core 33 faster than other catalysts.

During or after curing of the core 33, purging is undertaken by passing a fluid such as compressed air through the hose 140, the conduit 115 and the second passage 70 into the cavity 32 to help distribute and thereafter clear out the hardening fluid. This may be accomplished using valves or other conventional flow control devices to pass air into the second passage 70.

Following purging, the drag 29 and the core 33 may be lowered by the ram 23 or other lifting mechanism while the cope 26 is maintained in position by the cope clamps 27. Ejection pins 143 disposed in bores 146 in the drag 29 are connected to an ejector plate 147 (FIG. 3) that eventually contacts a surface 148 (FIG. 3) so that further downward movement of the pins 143 and the core 33 is prevented. Continued downward movement of the drag 29 spaces the drag 29 from the core 33 so that the core 33 can be removed. In an alternative ejection sequence, the cope 26 is raised relative to the drag 29 and the ejection pins 143 are raised relative to the drag 29, ejecting the core 33. Ejection may be performed at an ejection station 149, as shown in FIG. 1.

Although shown at the parting line 41 in FIG. 2, the first outlet 79 need not be level with the parting line 41 during sand injection but rather can be any height at which the first outlet 79 is in fluid communication with the cavity 32. Similarly, the second outlet 91 does not have to be disposed level with the parting line 41 during hardening fluid introduction, as is shown in FIG. 3, but rather the second outlet 91 can be any height at which the second outlet 91 is in fluid communication with the cavity 32.

Although both of the outlets 79, 91 are shown located in the outer surface 57 of the tube 19 in FIGS. 2–5, either one or both of the outlets 79, 91 may alternatively be located in the bottom 48 of the tube 19. For example, if the first outlet 79 is located in the bottom 48 of the tube 19, then sand injection may be performed while the tube 19 is fully inserted into the bore 35, and gas introduction may be performed following the raising of the tube 19 relative to the core box 21 (or the lowering of the core box 21). The geometry of the core or cores 33 is one factor in determining whether such an outlet configuration is advantageous.

The relative heights of the first and second outlets 79, 91 may be varied so long as the first and second outlets 79, 91 are not simultaneously in fluid communication with the cavity 32 during sand injection or gassing. For example, in the embodiment shown in FIGS. 6 and 7, a tube 151 has a first outlet 79 disposed closer to the bottom surface 48 of the tube 151 than a second outlet 91. The other features of the tube 151 are similar to the tube 19 of the embodiment of FIGS. 2–5.

Figure 6:
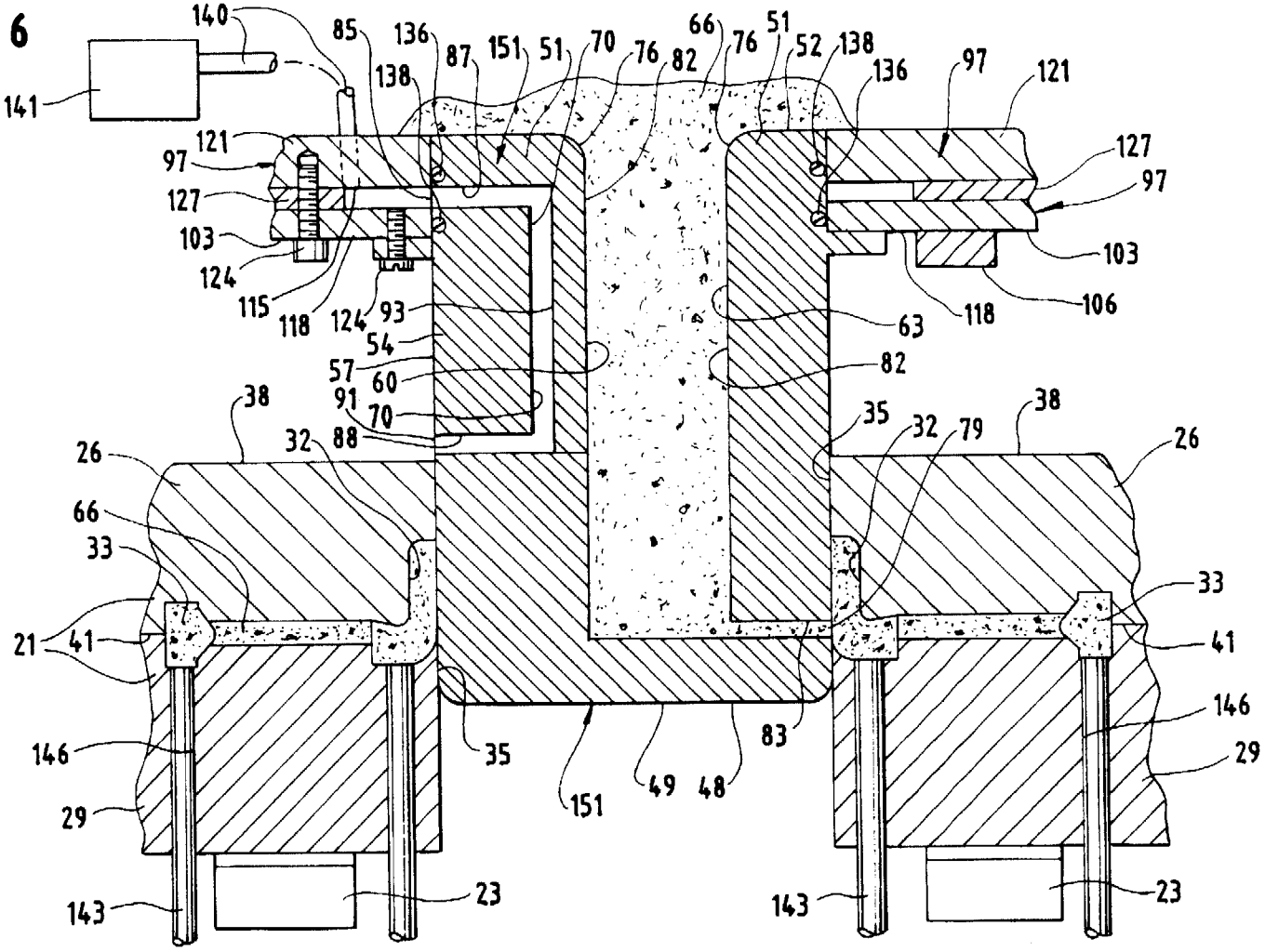
FIG. 6 comprises a sectional view similar to FIG. 2 of a further embodiment of the present invention shown during sand injection.
Figure 7:
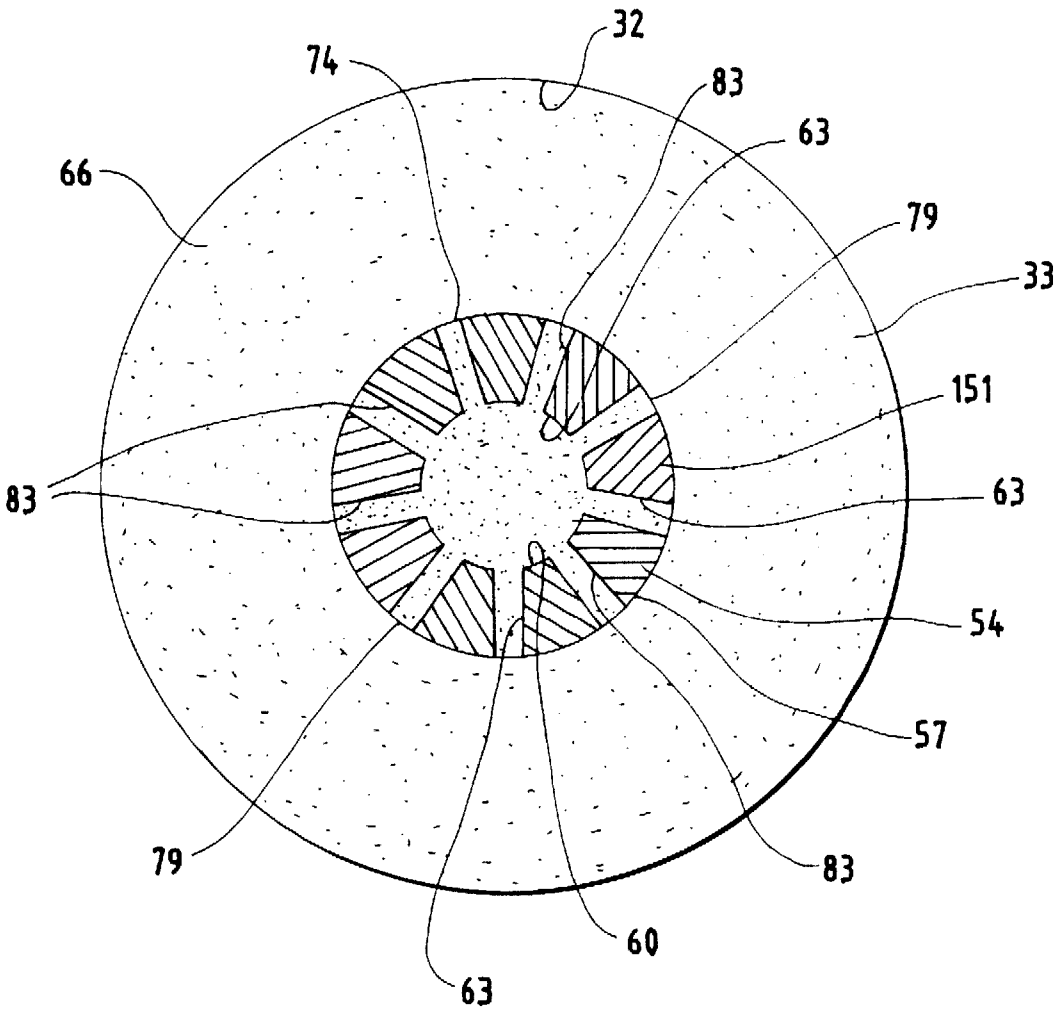
FIG. 7 comprises a sectional view similar to FIG. 4 of the embodiment of FIG. 6 shown during sand injection.

In operation, the tube 151 is not fully inserted into the core box 21 during sand injection, but rather the tube 151 is suspended by the blowhead 17 at a height at which the first outlet 79 is in fluid communication with the cavity 32, as seen in FIGS. 6 and 7. In this position, the second outlet 91 is not in fluid communication with the cavity 32.

Following sand injection, the tube 151 is lowered (or the core box 21 is raised) until the support block 106 contacts the top surface 38 of the cope 26. At that point, the second outlet 91 is in fluid communication with the cavity 32 and the first outlet 79 is no longer in fluid communication with the cavity 32. Hardening fluid is then passed through the second passage 70 into the cavity 32 to cure the core 33. The delivery of the hardening fluid and ejection of the core 33 may be performed similarly to the corresponding operations described above in connection with the embodiment of FIGS. 2–5.

The first and second lateral portions 83, 88 leading to the first and second outlets 79, 91, respectively, may be oriented perpendicular to the longitudinal axis of the tube 151 or at an angle other than a right angle with respect to the longitudinal axis of the tube 151, as discussed in more detail above in connection with the embodiment of FIGS. 2–5.

Although both of the outlets 79, 91 are shown located in the outer surface 57 of the tube 151 in FIGS. 6 and 7, either one or both of the outlets 79, 91 may alternatively be located in the bottom 48 of the tube 151. For example, if the second outlet 91 is located in the bottom 48 of the tube 151, then gas introduction may be performed while the tube 151 is fully inserted into the bore 35 (after the lowering of the tube 151 relative to the core box 21 following sand injection). The geometry of the core or cores 33 is one factor in determining whether such an outlet configuration is advantageous.

Figure 8:
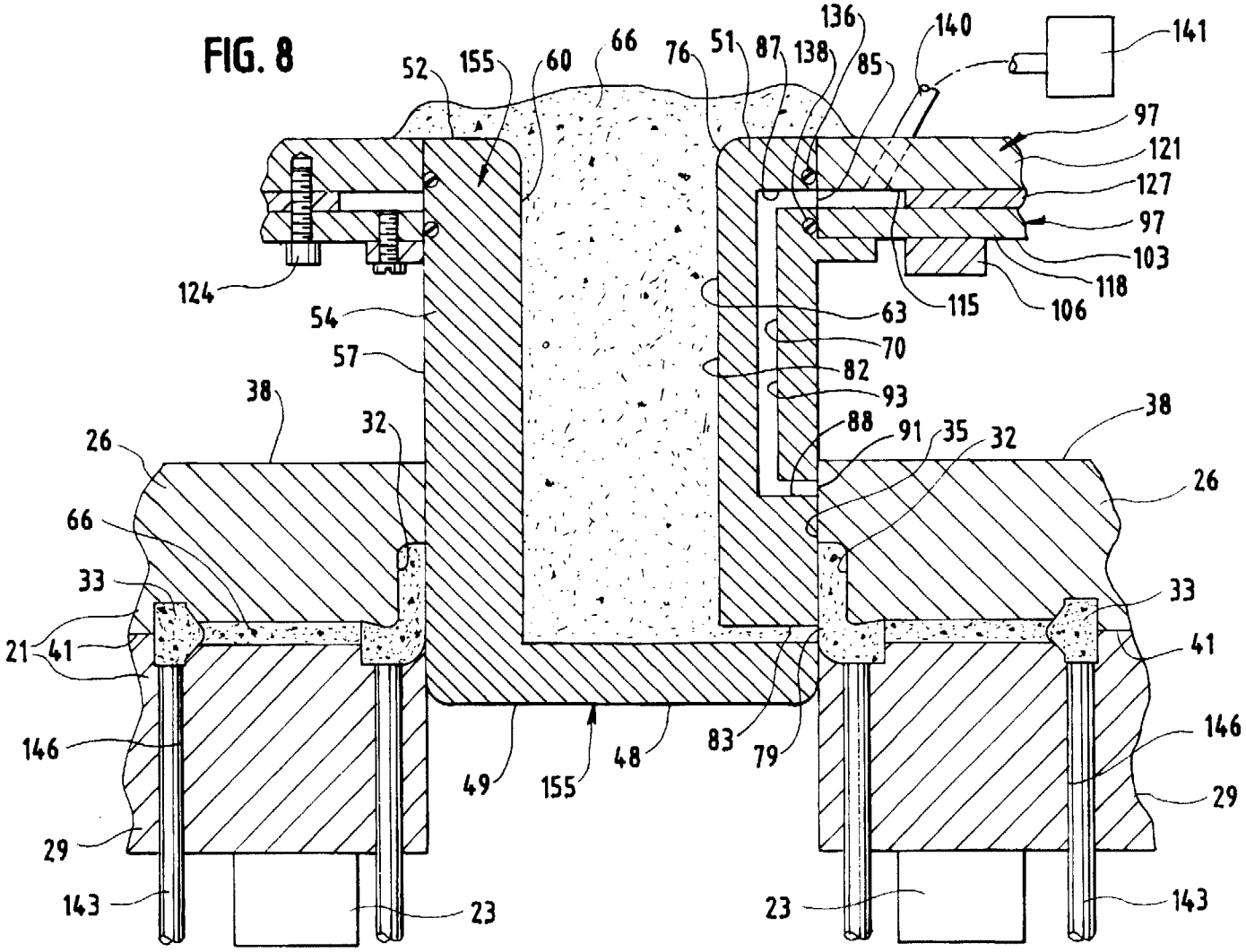
FIG. 8 comprises a sectional view similar to FIG. 2 of an injection tube in accordance with another embodiment of the present invention shown during sand injection.

As shown in FIG. 8, the second outlet 91 and the second lateral portion 88 may be, although are not necessarily, disposed above the first outlet 79 and the first lateral portion 83 so that both the first and second lateral portions 83, 88 are vertically aligned, i.e., intersected by the same vertical plane extending through the longitudinal axis of a tube 155. If desired, the first outlet 79 and the first lateral portion 83 may alternatively be disposed above the second outlet 91 and the second lateral portion 88. Also in this case, the first and second lateral portions 83, 88 may be vertically aligned, if desired or necessary.

In the embodiment of FIG. 8, at most one of the first and second outlets 79, 91 can be located level with the parting line 41 at one time.

Core hardening can be performed by moving the tube 155 vertically after sand injection, but prior to hardening fluid introduction, in order to place the second outlet 91 in fluid communication with the cavity 32 and take the first outlet 79 out of fluid communication with the cavity 32.

Figure 9:
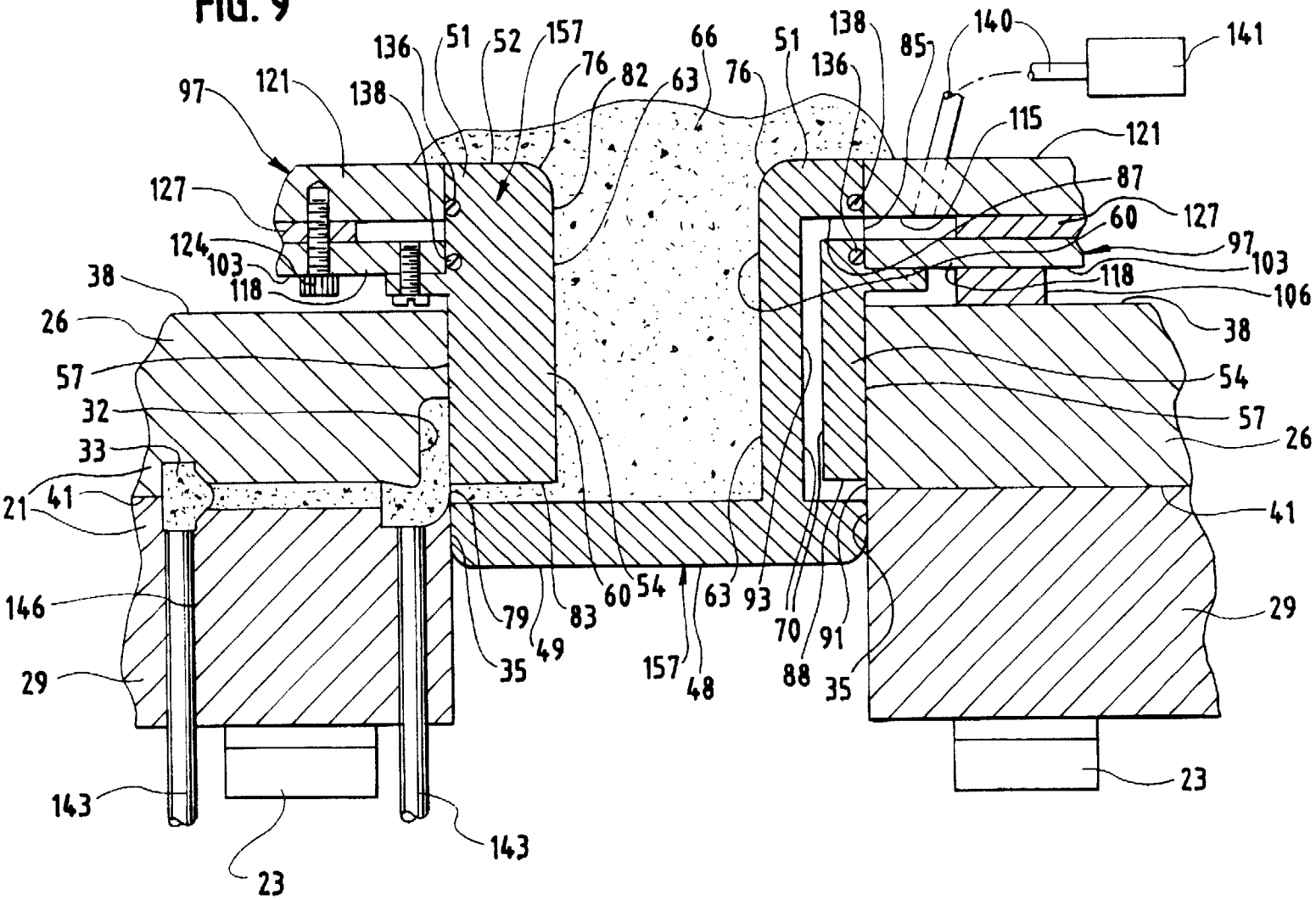
FIG. 9 comprises a sectional view similar to FIG. 2 of an injection tube in accordance with another embodiment of the present invention shown during sand injection.

As shown in FIG. 9, an injection tube 157 has the first and second outlets 79, 91 located at substantially the same distance from the bottom surface 48 of the injection tube 157. The second outlet 91 is not in fluid communication with the cavity 32 during sand injection.

Figure 10:
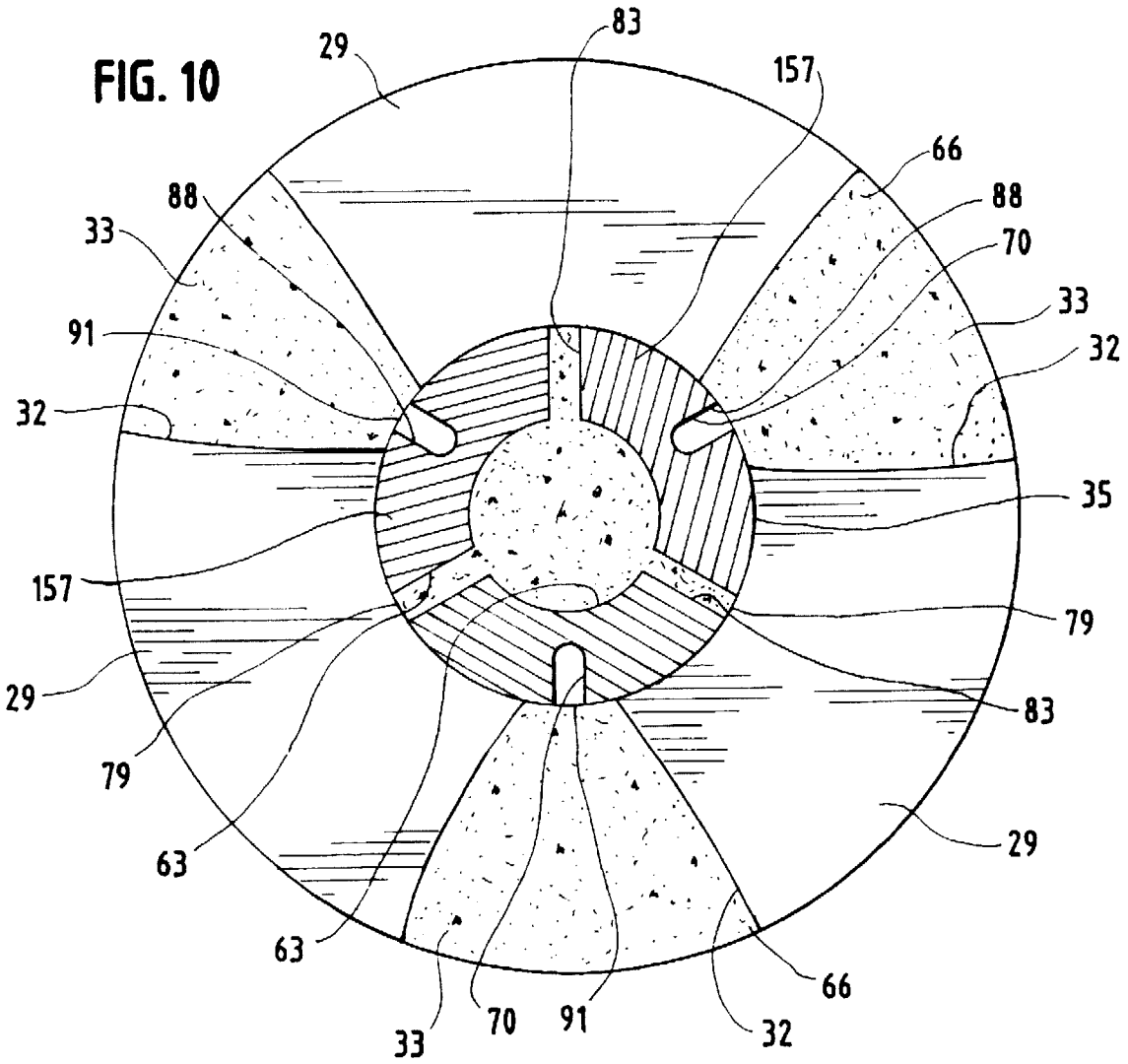
FIG. 10 comprises a sectional view similar to FIG. 4 of the embodiment of FIG. 9 shown during introduction of hardening fluid.

Following sand injection, the tube 157 is rotated around the longitudinal axis thereof to the position shown in FIG. 10 in which the second outlet 91 is in fluid communication with the cavity 32 and the first outlet 79 is no longer in fluid communication with the cavity 32. Introduction of hardening fluid into the cavity 32 is then performed. Thus, the operation of the tube 157 is similar to the operation of the tubes 19, 151, and 155, but the tube 157 is rotated rather than raised or lowered to move the first and second outlets 79, 91 in and out of fluid communication with the cavity 32.

The amount of rotation may vary depending, in part, upon the number of and the configuration of the cavities 32. In FIG. 10, for example, the amount of rotation required between sand injection and hardening fluid introduction is about 60 degrees.

If desired, the first and second lateral portions 83, 88 of the tube 157 may be oriented at transverse angles other than a right angle with respect to the longitudinal axis of the tube 157, as discussed in connection with the embodiments shown in FIGS. 2–5.

Although shown at the parting line 41 in FIG. 9, the first outlet 79 and the second outlet 91 do not have to be level with the parting line 41 during sand injection or hardening fluid introduction, respectively, but rather can be any height at which the first and second outlets 79, 91 are in fluid communication with the cavity 32.

As described above, each injection tube 19, 151, 155, and 157 shown in FIGS. 1–10 can be used for both sand injection and hardening of the cores 33. Thus, after completing sand injection, no travel to a different station is necessary for hardening fluid introduction, and hence production cycle time is reduced. Also, conventional sand injection tubes have to be completely removed from the core box 21 to allow for placement of a gassing plate on the core box 21, following sand injection, in order to perform the hardening step. In contrast, a core making machine utilizing one of the tubes 19, 151, 155, and 157 does not require placement of a gassing plate on the core box 21 between sand injection and hardening fluid introduction.

It should be noted that a conventional molding apparatus, including such apparatus utilizing multiple injection tubes per cycle, may be retrofitted with any of the injection tubes 19, 151, 155, and 157 of the present invention. However, the structure for attaching the various tubes 19, 151, 155, and 157 to the blowhead 17 may be slightly different in each case.

As seen in FIGS. 1–10, the first and second passages 63, 70 preferably do not intersect so that the possibility of hardened sand clogging the passages 63, 70 is minimized.

Figure 4:
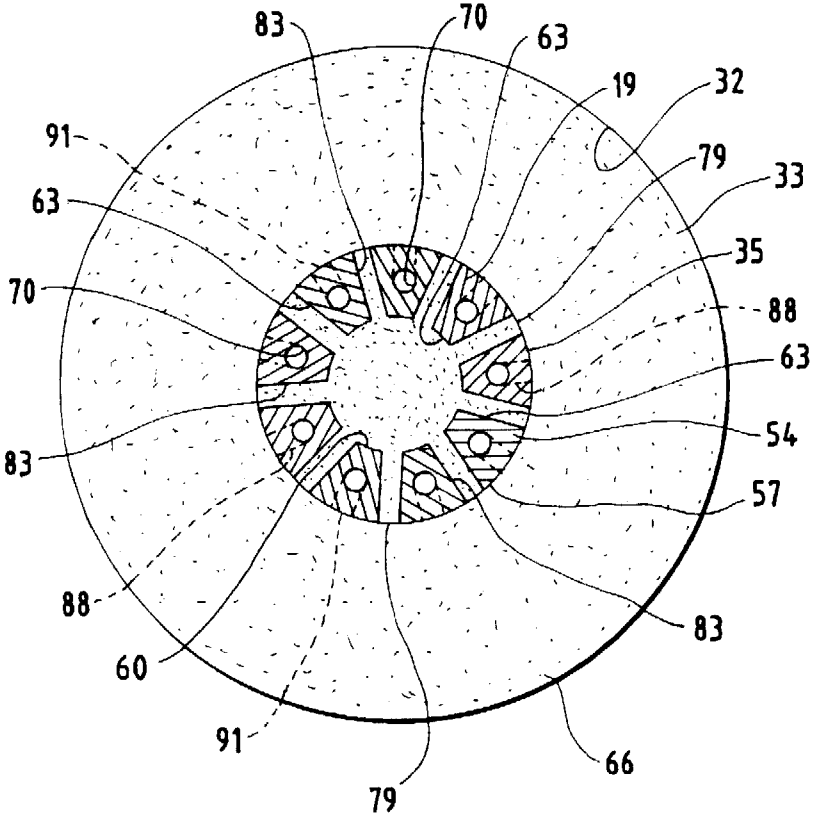
FIG. 4 comprises a sectional view taken generally along the lines 4—4 of FIG. 2.

If desired, a plurality of each of the first and second lateral portions 83, 88 may be disposed in the tubes 19, 151, 155, and 157 to insure that the sand 66 and hardening fluid are uniformly injected into the cavity or cavities 32. In such a case, a pattern of alternating first and second lateral portions 83, 88 that are offset from one another, as shown in FIG. 4, is preferred in order to increase the mixing of the sand 66 and hardening fluid in the cavity or cavities 32. The optimum number of and orientation of the first and second lateral portions 83, 88 may vary depending upon the number of and shape of the cores 33 to be formed and other variables. Similarly, the number of and orientation of the first and second main portions 82, 93 extending to the first and second lateral portions 83, 88, respectively, may also vary.

Figure 11:
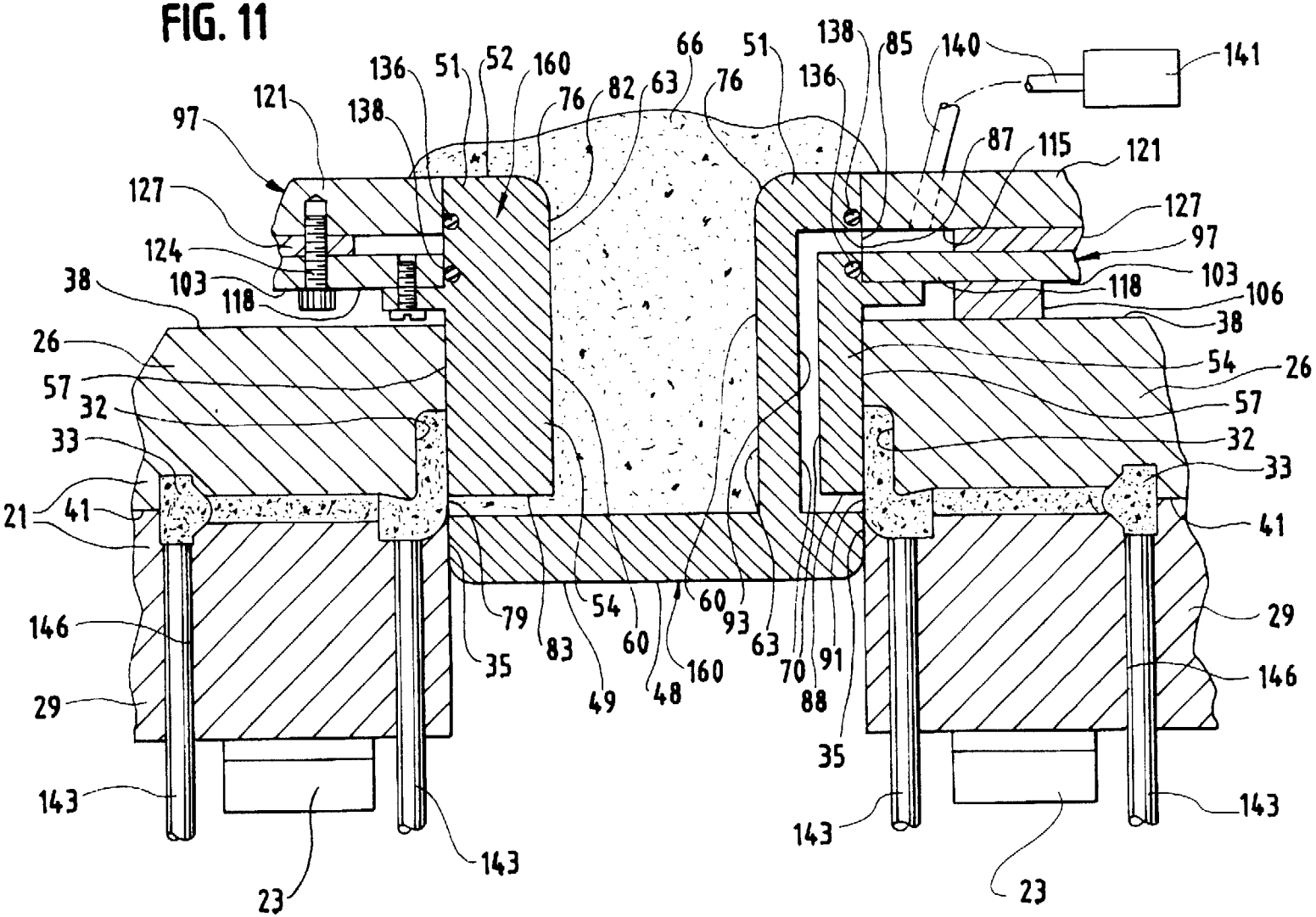
FIG. 11 comprises a sectional view similar to FIG. 2 of an injection tube in accordance with another embodiment of the present invention shown in a position for sand and hardening fluid injection.
Figure 12:
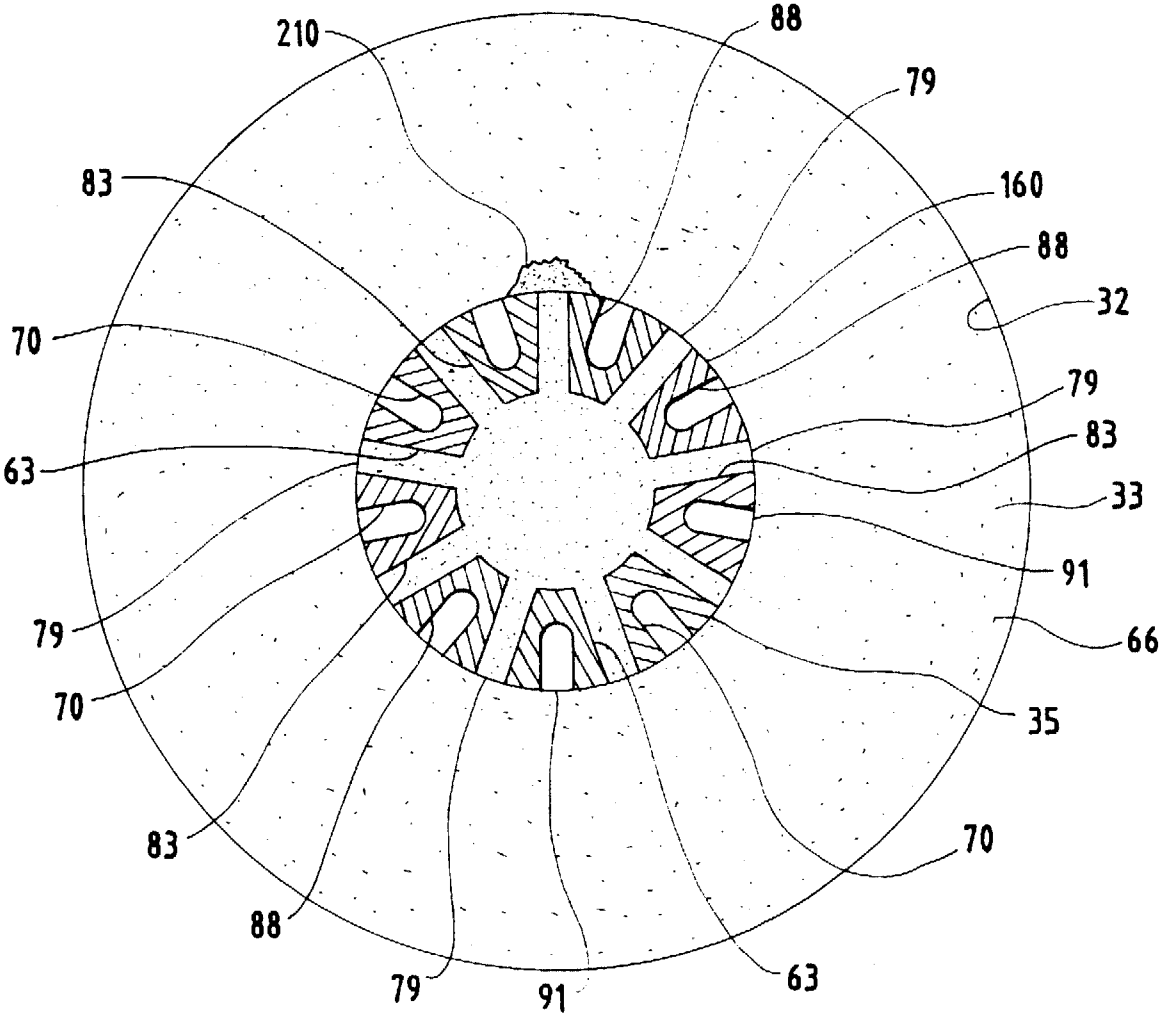
FIG. 12 comprises a sectional view similar to FIG. 4 of the embodiment of FIG. 11 shown in a position for sand and hardening fluid injection.

In another embodiment, shown in FIGS. 11 and 12, the sand 66 can be injected simultaneously with the hardening fluid. An injection tube 160 in accordance with this embodiment has one or more first and second outlets 79, 91 located substantially the same distance from the bottom surface 48 of the injection tube 160.

In operation, the tube 160 is positioned so that the support block 106 is in contact with the cope 26 and, at that point, the first and second outlets 79, 91 are in fluid communication with the cavity 32. The sand 66 may be injected and hardening fluid may be simultaneously introduced into the cavity 32. Hardened core ejection can be performed as described for the embodiment shown in FIGS. 2–5.

Although the first and second outlets 79, 91 are shown located at substantially the same distance from the bottom surface 48 and are shown level with the parting line 41 in FIG. 11, during sand and hardening fluid injection it is only necessary that the first and second outlets 79, 91 be in fluid communication with the cavity 32 simultaneously. Thus, the outlets 79, 91 need not be level with the parting line 41 or even at the same distance from the bottom surface 48 for simultaneous sand injection and hardening fluid introduction to be performed.

The geometry of the cavity 32 is one variable for determining the optimum location of the first and second outlets 79, 91 relative to the parting line 41 during sand injection and hardening fluid introduction.

Depending on the filling characteristics of the particular cavity 32, the angle of the first and second lateral portions 83, 88 with respect to the longitudinal axis of the tube 160 can be an angle other than a right angle, as described above in connection with the embodiment of FIGS. 2–5.

Although both of the outlets 79, 91 are shown located in the outer surface 57 of the tubes 157 and 160 in FIGS. 9–12, either one or both of the outlets 79, 91 may alternatively be located in the bottom 48 of the tubes 157 and 160. In the embodiment shown in FIGS. 9 and 10, rotation would be required to place the second outlet 91 in fluid communication with the cavity 32 following sand injection, whether the first outlet 79 or the second outlet 91 is located in the bottom 48 of the tube 157. In the case of the embodiment in FIGS. 11 and 12, simultaneous injection of sand and hardening fluid may be performed having either the first outlet 79 or the second outlet 91 located in the bottom 48 of the tube 160.

Figure 13:
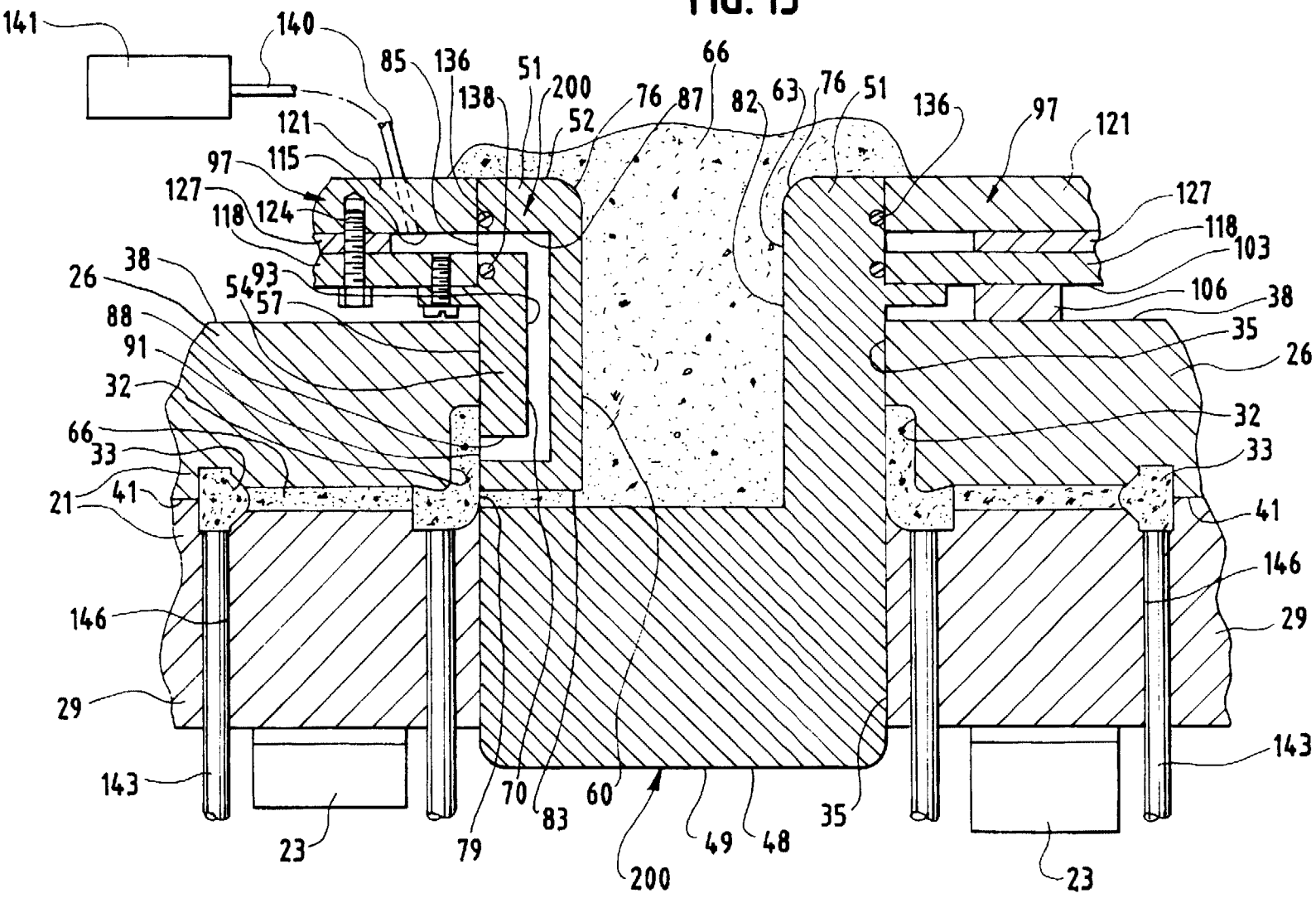
FIG. 13 comprises a sectional view similar to FIG. 2 of an injection tube in accordance with another embodiment of the present invention shown in a position for sand and hardening fluid injection.

FIG. 13 illustrates yet another embodiment of the present invention which can simultaneously inject sand and hardening fluid into the cavity 32. In this embodiment, the second outlet 91 and the second lateral portion 88 may be disposed above the first outlet 79 and the first lateral portion 83 so that both the first and second lateral portions 83, 88 are intersected by the same vertical plane extending through the longitudinal axis of a tube 200. Alternatively, the second outlet 91 and the second lateral portion 88 may be disposed below the first outlet 79 and the first lateral portion 83.

The simultaneous injection of sand and hardening fluid is efficient because, unlike conventional injection, simultaneous injection does not require the placement of a gassing plate on the core box 21 after sand injection in order to perform hardening fluid injection. Also, unlike the embodiments of FIGS. 2–10, simultaneous sand and hardening fluid injection does not require repositioning of the injection tubes 160, 200 after sand injection and before hardening fluid injection.

As with the embodiments discussed earlier, the first passage 63 is preferably not in fluid communication with the second passage 70. This prevents clogging of the tubes 160, 200 by keeping the core sand 66 segregated from the hardening fluid until the core sand 66 and the hardening fluid pass into the cavity 32.

As discussed in connection with the embodiment illustrated in FIGS. 2–5, the core box 21 can have a plurality of cavities 32 and can therefore form a plurality of cores 33 per cycle.

Although the embodiments shown in FIGS. 11–13 have the first and second outlets 79, 91 in fluid communication with the cavity 32 simultaneously, these embodiments are also suitable for producing the sand cores 33 by injecting the sand 66 prior to introducing hardening fluid. It should be noted, however, that hardening in the tubes 160, 200 may occur if a negative air flow condition is established wherein hardening fluid flows from the cavity 32 back into the first passage 63, thereby curing some of the sand 66 located therein. If, instead, positive or forward air flow is maintained through the first passage 63 during hardening fluid introduction, then hardening in the tubes 160, 200 may be avoided because little or no hardening fluid will flow through the first outlets 79 into the first passage 63 to harden the sand 66 therein. However, a soft or uncured portion 210 (FIG. 12) may form in the cores 33.

The soft portions 210 are generally located adjacent the first outlet 79, as shown in FIG. 12, and are of no detriment to the performance of the cores 33 during metal casting if the soft portions 210 are located in the core print area of the cores 33. The core print area is the area of a core 33 that does not contact molten metal during casting, but rather contacts, and is attached to, the cope or the drag of the molten metal casting equipment.

Simultaneous injection of sand and hardening fluid avoids hardening in the tubes 160, 200, however, it also results in the soft portion 210 in the cores 33. In some situations, such as for cores 33 having a geometry in which the soft portions 210 are undesirable, it may be advantageous to inject the core sand 66 prior to introducing hardening fluid into the cavity 32. If, however, the soft portions 210 are not undesirable for a core 33 of a particular geometry, the speed of simultaneous injection of sand and hardening fluid may make the embodiments of FIGS. 11–13 preferable for production of such cores 33.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. Apparatus for injecting foundry sand into a core box, comprising:

an injection tube having first and second ends and a side wall disposed between the first and second ends;

a sand injection passage disposed in the injection tube; and a hardening fluid passage also disposed in the injection tube;

wherein at least one of the sand injection passage and the hardening fluid passage includes an outlet in the side wall, and the sand injection passage is not in fluid communication with the hardening fluid passage.

2. The apparatus of claim 1, wherein the sand injection passage and the hardening fluid passage include first and second outlets, respectively, in the side wall.

3. The apparatus of claim 2, wherein the first and second outlets are disposed at different distances from one of the first and second ends.

4. The apparatus of claim 2, wherein the first and second outlets are disposed at substantially equal distances from one of the first and second ends.

5. Apparatus for injecting foundry sand into a core box having a cope, a drag, and a cavity therebetween, comprising:

an injection tube having a side wall, a first passage for passing foundry sand into the cavity, and a second passage for passing hardening fluid into the cavity;

the first passage having a first outlet in the side wall and a first lateral portion extending to the first outlet; and the second passage having a second outlet in the side wall and a second lateral portion extending to the second outlet;

the first passage not being in fluid communication with the second passage.

6. The apparatus of claim 5, wherein the first outlet is located farther from a bottom of the injection tube than the second outlet.

7. The apparatus of claim 5, wherein the first and second outlets are located level with a parting line defined by the cope and the drag during sand injection.

8. The apparatus of claim 5, wherein the first outlet is located level with a parting line defined by the cope and the drag during sand injection and the second outlet is not located level with the parting line during sand injection.

9. The apparatus of claim 5, wherein the first lateral portion is perpendicular to a longitudinal axis of the injection tube.

10. The apparatus of claim 5, wherein the second lateral portion is perpendicular to a longitudinal axis of the injection tube.

11. The apparatus of claim 5 in combination with:

sand injection apparatus in fluid communication with the first passage; and hardening fluid introduction apparatus in fluid communication with the second passage.

12. Apparatus for injecting foundry sand into a core box having a cope, a drag, and a cavity therebetween, comprising:

an injection tube having a bottom, a first passage for passing foundry sand into the cavity, and a second passage for passing hardening fluid into the cavity;

the first passage having a first inlet and a first outlet; and the second passage having a second inlet and a second outlet;

the first and second outlets being located at different distances from the bottom of the injection tube, the first passage not being in fluid communication with the second passage.

13. The apparatus of claim 12, wherein the first outlet is located farther from the bottom of the injection tube than the second outlet.

14. The apparatus of claim 12, wherein the first and second outlets are in fluid communication with the cavity during sand injection.

15. The apparatus of claim 12, wherein the second outlet is in fluid communication with the cavity during introduction of hardening fluid and the first outlet is not in fluid communication with the cavity during introduction of hardening fluid.

16. The apparatus of claim 12 in combination with:

sand injection apparatus in fluid communication with the first passage; and hardening fluid introduction apparatus in fluid communication with the second passage.

17. The apparatus of claim 13, wherein the first and second outlets are intersected by the same vertical plane extending through the longitudinal axis of the tube.

18. The apparatus of claim 17, wherein the first and second outlets are in fluid communication with the cavity during sand injection.

19. The apparatus of claim 17, wherein the second outlet is in fluid communication with the cavity during introduction of hardening fluid and the first outlet is not in fluid communication with the cavity during introduction of hardening fluid.

20. A method of producing hardened sand cores in a cavity of a core box, the method comprising the steps of:

providing a tube having first and second passages including first and second outlets, respectively, located in a side wall of the tube;

injecting sand through the first passage into the cavity to produce cores; and introducing hardening fluid through the second passage into the cavity to harden the cores.

21. The method of claim 20, wherein the steps of injecting sand and introducing hardening fluid are performed simultaneously.

22. The method of claim 20, wherein the step of injecting sand is completed prior to initiating the step of introducing hardening fluid.

23. The method of claim 20, wherein the step of injecting sand further comprises injecting sand perpendicular to a longitudinal axis of the tube.

24. A method of producing hardened sand cores in a cavity of a core box, the method comprising the steps of:

providing a tube having a first passage including a first outlet and a second passage having a second outlet;

injecting sand through the first passage into the cavity to produce cores;

adjusting the position of the tube relative to the core box to place the second outlet in fluid communication with the cavity; and introducing hardening fluid through the second passage into the cavity to harden the cores.

25. The method of claim 24, wherein the step of injecting sand further comprises the step of injecting sand perpendicular to a longitudinal axis of the injection tube.

26. The method of claim 24, wherein the step of adjusting the position of the tube comprises raising the tube relative to the core box.

27. The method of claim 24, wherein the step of adjusting the position of the tube comprises rotating the tube relative to the core box.

* * * * *